US005250936A

United States Patent [19]

Warren et al.

[11] Patent Number: 5,250,936

[45] Date of Patent: Oct. 5, 1993

[54] METHOD FOR DRIVING AN INDEPENDENT SUSTAIN AND ADDRESS PLASMA DISPLAY PANEL TO PREVENT ERRANT PIXEL ERASURES

[75] Inventors: Kevin W. Warren, Champaign, Ill.; Larry F. Weber, New Paltz, N.Y.

[73] Assignee: Board of Trustees of the University of Illinois, Urbana, Ill.

[21] Appl. No.: 512,880

[22] Filed: Apr. 23, 1990

[51] Int. Cl.[5] ..... G09G 3/22

[52] U.S. Cl. ..... 345/60; 345/68

[58] Field of Search ..... 340/771, 775, 776, 805; 315/169.4

[56] References Cited

U.S. PATENT DOCUMENTS

| | | | |
|---|---|---|---|
| 3,559,190 | 1/1971 | Bitzer et al. | 340/173 |
| 3,906,451 | 9/1975 | Strom | 340/771 |
| 4,097,780 | 6/1978 | Ngo | 340/771 |
| 4,591,847 | 5/1986 | Criscimagna | 340/776 |
| 4,772,884 | 9/1988 | Weber et al. | 340/776 |

*Primary Examiner*—Ulysses Weldon
*Attorney, Agent, or Firm*—Perman & Green

[57] ABSTRACT

A method is described for erasing pixel cells in an ISA AC plasma display panel. The panel comprises a plurality of cell groups aligned along horizontal and vertical dimensions, each cell group including an address cell, two vertical coupling cells, two horizontal coupling cells, and four pixel cells. Horizontal and vertical address lines are provided and intersect each address cell, and sustain lines are positioned on either side of the address lines and intersect adjacent series of pixel cells and coupling cells in each cell group. Intersections between sustain lines define pixel cells by type, with each cell group having identical first through fourth types at corresponding sustain line intersections. The method comprises: energizing the address and sustain lines line to turn ON at least a selected first type pixel cell in an addressed cell group, the first type pixel cell and a second type pixel cell defined by intersections between a horizontal sustain line and first and second vertical sustain lines; applying sustain signal pulses to all the sustain lines, with at least one less sustain signal pulse being applied to vertical sustain lines which define the second type pixel cell in all cell groups; and subsequently applying to the sustain lines, a sustain potential to cause erasure of the selected first type pixels in the addressed cell groups.

17 Claims, 12 Drawing Sheets

METHOD FOR DRIVING AN INDEPENDENT SUSTAIN AND ADDRESS PLASMA DISPLAY PANEL TO PREVENT ERRANT PIXEL ERASURES

FIELD OF THE INVENTION

This invention relates to independent sustain and address AC plasma display panels, and more particularly to a method for preventing unwanted pixel erasures in such panels.

BACKGROUND OF THE INVENTION

A. C. Plasma display panels are well known in the art and, in general, comprise a pair of transparent substrates respectively supporting column and row electrodes, each coated with a dielectric layer and disposed in parallel spaced relation to define a gap therebetween in which an ionizable gas is sealed. The substrates are arranged such that the electrodes are disposed in orthogonal relation to one another thereby defining points of intersection which in turn define discharge cells at which selective discharges may be established to provide a desired storage or display function. It is also known to operate such panels with AC voltages and particularly to provide a write voltage which exceeds the firing voltage at a given discharge point, as defined by a selected column and row electrode, thereby to produce a discharge at a selected cell. The discharge at the selected cell can be continuously "sustained" by applying an alternating sustain voltage (which, by itself is insufficient to initiate a discharge). This technique relies upon the wall charges which are generated ON the dielectric layers of the substrates which, in conjunction with the sustain voltage, operate to maintain discharges.

Details of the structure and operation of such gas discharge panels or plasma displays are set forth in U.S. Pat. No. 3,559,190 issued Jan. 26, 1971 to Donald L. Bitzer, et al.

Various attempts have been made to reduce the costs inherent in AC plasma panel structures. One of the more successful is described in U.S. Pat. No. 4,772,884 and is entitled "Independent Sustain and Address Plasma Display Panel", by Weber et al. (one of the inventors hereof). That patent describes an electrode geometry change from the standard AC plasma technology wherein the address and sustain functions are carried out ON separate panel electrode structures. Separating those two functions has enabled implementation of both a different addressing scheme and provided reductions, by a factor of two, in the number of required address drivers (as compared to the number required for the standard AC plasma technology). Additionally, improvements in addressing have rendered such electrode structures fully competitive, responsewise, with competing display technologies. Such addressing improvements are disclosed in commonly assigned U.S. patent application Ser. No. 07/433,025, entitled "High Speed Addressing Method and Apparatus for Independent Sustain and Address Plasma Display Panel" by Warren and Weber.

In FIG. 1, an 8×8 pixel, independent sustain and address (hereinafter called "ISA") plasma panel schematic is shown. FIG. 2 shows an expanded view of the area in circle 10 in FIG. 1. The expanded view in FIG. 2 shows a basic nine cell group that is the repetitive unit in the ISA geometry. Each of the nine cells is defined in accordance with the types of electrodes that intersect to define a cell. In plasma panels existing prior to the ISA technology, all cells on the panel were electrically identical and, in fact, were all display pixels. However, in an ISA panel, only four of the nine cells of a cell group are display pixels i.e. P1, P2, P3, and P4. Those pixel cells are located at the intersections of four sustain electrodes XSa, XSb, YSa, and YSb. Thus, each cell group has four corresponding pixel cell types. As will be understood hereafter, each corresponding cell type (e.g., P1, P2, etc.) in each cell group is subjected to identical sustain potentials during the operation of a panel, but its response to such potentials is controlled by potentials imposed on address lines which intersect each cell group.

In addition to the four pixel cell types, there are five other cells in a cell group. At the center of the cell group is an address cell A which occurs at the intersection of two address electrodes XA and YA. There are also four coupling cells: C1, C2, C3, and C4 which occur at the intersections of a sustain electrode and an address electrode. The coupling cells are divided into two categories depending upon their position relative to the address cell. The C1 and C4 cells are called vertical coupling cells and the C2 and C3 cells are called horizontal coupling cells. It should be understood, that the terms vertical and horizontal are used merely to designate orthogonal orientations of conductors and cells and for easy reference purposes. No particular global orientation is to be implied therefrom.

In one preferred embodiment, all horizontal electrodes of the ISA panel reside on one substrate of a panel and are referred to as the Y electrodes. All vertical electrodes reside on an opposite substrate and are termed X electrodes. As is well known, between the substrates, an ionizable gas is positioned and provides the selected cell illumination. The X address electrodes comprise electrodes 12, 14, 16 and 18 whereas the Y electrodes comprise 20, 22, 24, and 26. Each X electrode can be selectively addressed by a column address driver circuit 28 and each Y address line can be addressed by a row address driver circuit 30.

X sustain signals are provided by two, phased, sustain generators 32 and 34, with each of the aforementioned sustain generators coupled to a connected pair of parallel sustain lines (e.g. 36, 38). Each pair of sustain lines, e.g. 36, 38, is shorted together by shorting bars at either end, thus forming a sustain electrode pair. Alternating sustain electrode pairs ON a given substrate are bussed together by a sustain bus and are connected to one of the two sustain drivers Row sustain drivers 40 and 42 are similarly connected to interspersed row sustain pairs.

In FIG. 3, waveforms are shown which describe a basic cycle for an ISA plasma panel as described in the aforementioned U.S. Pat. No. 4,772,884. In a preferred mode of operation, two rows of pixel cells are initially turned ON. Then, an erase cycle is performed to selectively turn off pixels which the image data indicate should be in the off state. The waveforms of FIG. 3 assume that a "write two rows" cycle has already occurred. The selective erase of certain desired ON pixels encompasses two steps. The first step causes a discharge to occur in selected address cells along a selected YA address electrode (see FIG. 2). This results in the migration of wall charges into vertical coupling cells C1 and C4.

This is described in more detail by the waveform diagram of FIG. 3. Prior to the selective erase cycle occurring, a reset pulse is applied to an address line to reset the wall voltages in vertical coupling cells C1 and C4 and address cell A. The simultaneous application of sustain voltages to XSa, XSb and YSa, YSb sustain lines with the reset pulses will cause small discharges to occur in the coupling cells which serve to adjust their wall voltages.

Subsequently, erase address pulses 50 and 52 are applied to the XA and YA address lines respectively. This commences Step 1 of the selective erase procedure and its effect is shown in FIG. 4. The erase address waveforms are polarized so that the XA and YA electrodes are the anode and cathode respectively. Since the XA electrode is the anode, the plasma discharge 54, which occurs at address cell A, spreads predominantly towards vertical coupling cells C1 and C4. The voltage across the gaps in each of coupling cells C1 and C4 is such that the spreading plasma deposits significant negative charge into these cells. In FIG. 5, a sectional illustration taken along line 5—5 in FIG. 4 (Step 1) is shown and illustrates the plasma spreading activity during Step 1 and the charges on the inner walls that are present at coupling cells C1 and C4 and address cell A.

Step 2 of the selective erase address performs two degrees of selection. It commences at the fall of erase address pulses 50 and 52 and the rise of certain selection potentials on the sustain electrodes. As shown in FIG. 5, Step 1 deposited equal amounts of wall charge into coupling cells C1 and C4 when address cell A was discharged. By raising only the Y sustain line associated with a selected vertical coupling cell, the unselected vertical coupling cell, defined by the non-raised Y sustain line, will not discharge.

During Step 2, the selected YS and XA electrodes are the anode and cathode respectively. This polarization enables the plasma generated by the discharge of a coupling cell to spread horizontally away from the cell and into neighboring pixel cells. Sectional views taken along line 6—6 in FIG. 4 (Step 2) are shown in FIGS. *6a–6d* and further aid in understanding the operation of the selective erase. In FIG. 3, the waveforms impressed on the X and Y sustain lines during Step 2 enable the selection of which of the pixel cells is to be erased.

In FIG. *6a*, it is assumed that Step 1 has already occurred; that coupling cell C1 has substantial wall charges which are polarized to provide a more positive voltage under the YSa electrode; and that both pixel cells P1 and P2 are in the ON state. At this point, it is desired to erase the P1 cell while leaving the P2 cell in its ON state. Thus, 100 volt potentials are applied to the XSa and YSa electrodes respectively, and zero volts are placed on the XA and XSb electrodes. The stored wall charges in coupling cell C1 add to the applied potential on the YSa electrode to cause a discharge in cell C1. At the same time, there occurs a discharge in cell P2 but none occurs in cell P1 due to the fact that identical voltages exist ON its bounding electrodes. The plasma which results from the discharge of cell C1 spreads along the YSa electrode and neutralizes any preexisting wall charges in cell P1, thereby causing it to be erased. Since cell P2 is already discharged, the migration of additional charge states thereinto has no effect.

In FIG. *6c*, a different set of initial conditions are assumed. In this case, cell P2 is in the off state and cell P1 is to be erased without affecting the state of cell P2. Since the dielectric immediately beneath the YSa electrode in cell P1 has a positive wall charge, the electrons resulting from a subsequent discharge of coupling cell C1 preferentially migrate thereto and neutralize the preexisting wall charge. Preexisting negative wall charges in pixel cell P2 tend to repel the electrons resulting from the discharge in coupling cell C1 and cell P2 remains unaffected. Thus it can be seen, that the sustain line that is raised during Step 2 of the selective erase, determines the type of pixel cell that will be erased. Therefore, to erase a selected type of pixel cell, the two sustain electrodes that define the selected pixel cell type should rise simultaneously, following the fall of the XA address pulse.

A problem has been encountered with the above-described addressing and sustain scheme. Certain ON pixels in non-addressed pixel groups tend to be erased during the Step 2 erase process. FIGS. *7a* and *7b* illustrate the problem in a non-addressed pixel group (i.e., any pixel group whose YA and XA address lines are not simultaneously pulsed), and show what happens during a Step 2 selective erase cycle in pixel cells that are of the same type as those in an addressed cell group.

The problem is initiated by the sustain discharge that occurs (during a pixel P1 erase cycle) in unselected, but ON, pixel P2 during Step 2 of the erase cycle. As above described with respect to FIG. *6b*, in an addressed cell group, the discharge of coupling cell Cl (caused by the application of a sustain pulse to the YSa electrode) causes electrons to spread along the YSa sustain line. However, since pixel cell P2 is in the ON state, the spread of charge thereinto has no effect. It is to be remembered, however, that each cell group in the panel has like sustain pulses applied to like cell types, notwithstanding the non-addressed states of the cell groups in which those pixel types reside.

In FIG. *7a*, a non-addressed cell group is illustrated with both pixel cells P1 and P2 being in the ON state (wall voltages existing therein from a prior discharge). The indicated wall charges in coupling cell C1 indicate that the cell group was not selected during Step 1 of the erase cycle. Nevertheless, the wall charges within coupling cell C1 evidence the deposition of electrons (and resulting negative charges). It again should be remembered that while the cell group in FIG. *7a* is non-addressed, that sustain pulses are still applied to sustain lines XSa and YSa during the Step 2 erase cycle. Since these sustain potentials are applied throughout the panel to both addressed and non-addressed cells, their effects on non-addressed cells must be such as to not affect their cell states. This has been found not to be the case.

As shown in FIG. *7b*, application of the sustain pulse to the YSa electrode causes a discharge in pixel cell P2 (it is in the ON state). It has been found that the plasma generated by the discharge in pixel cell P2 tends to spread along the YSa electrode and into pixel cell P1, thereby errantly erasing P1's ON state. This occurs notwithstanding the intermediately positioned negative wall voltages in coupling cell C1. This errant erase is found to occur only where both pixels on a common sustain line are in the ON state.

Obviously, while the above erase problem has been described with respect to pixel cell types P1 and P2, it can also occur with respect to other pixel types under similar circumstances. The cause of such errant erasures is not fully understood.

Accordingly, it is an object of this invention to provide an ISA AC plasma panel with improved performance characteristics.

It is another object of this invention to provide an ISA AC plasma panel which does not exhibit errantly erased pixel cells.

It is still another object of this invention to provide an ISA AC plasma panel with a method for sustaining ON pixel cells which prevents them from being erased during a Step 2 erase cycle.

SUMMARY OF THE INVENTION

A method is described for erasing pixel cells in an ISA AC plasma display panel. The panel comprises a plurality of cell groups aligned along horizontal and vertical dimensions, each cell group including an address cell, two vertical coupling cells, two horizontal coupling cells, and four pixel cells. Horizontal and vertical address lines are provided and intersect each address cell, and sustain lines are positioned on either side of the address lines and intersect adjacent series of pixel cells and coupling cells in each cell group. Intersections between sustain lines define pixel cells by type, with each cell group having identical first through fourth types at corresponding sustain line intersections. The method comprises: energizing the address and sustain lines line to turn ON at least a selected first type pixel cell in an addressed cell group, the first type pixel cell and a second type pixel cell defined by intersections between a horizontal sustain line and first and second vertical sustain lines; applying sustain signal pulses to all the sustain lines, with at least one less sustain signal pulse being applied to vertical sustain lines which define the second type pixel cell in all cell groups; and subsequently applying to the sustain lines, a sustain potential to cause erasure of the selected first type pixels in the addressed cell groups.

DETAILED DESCRIPTION OF THE INVENTION

The invention to be below described may be used with any of a number of ISA plasma panel addressing methods, however, for the purposes of this description, it will be described in the context of a write two rows and then selectively erase as described in U.S. Pat. No. 4,772,884, the contents of which are incorporated herein by reference.

The description herein will not further consider the write cycle other than to assume that all pixel types in a line of cell groups have been written. Then the selective erase commences. It is at this point where the invention is implemented.

Figure 8:
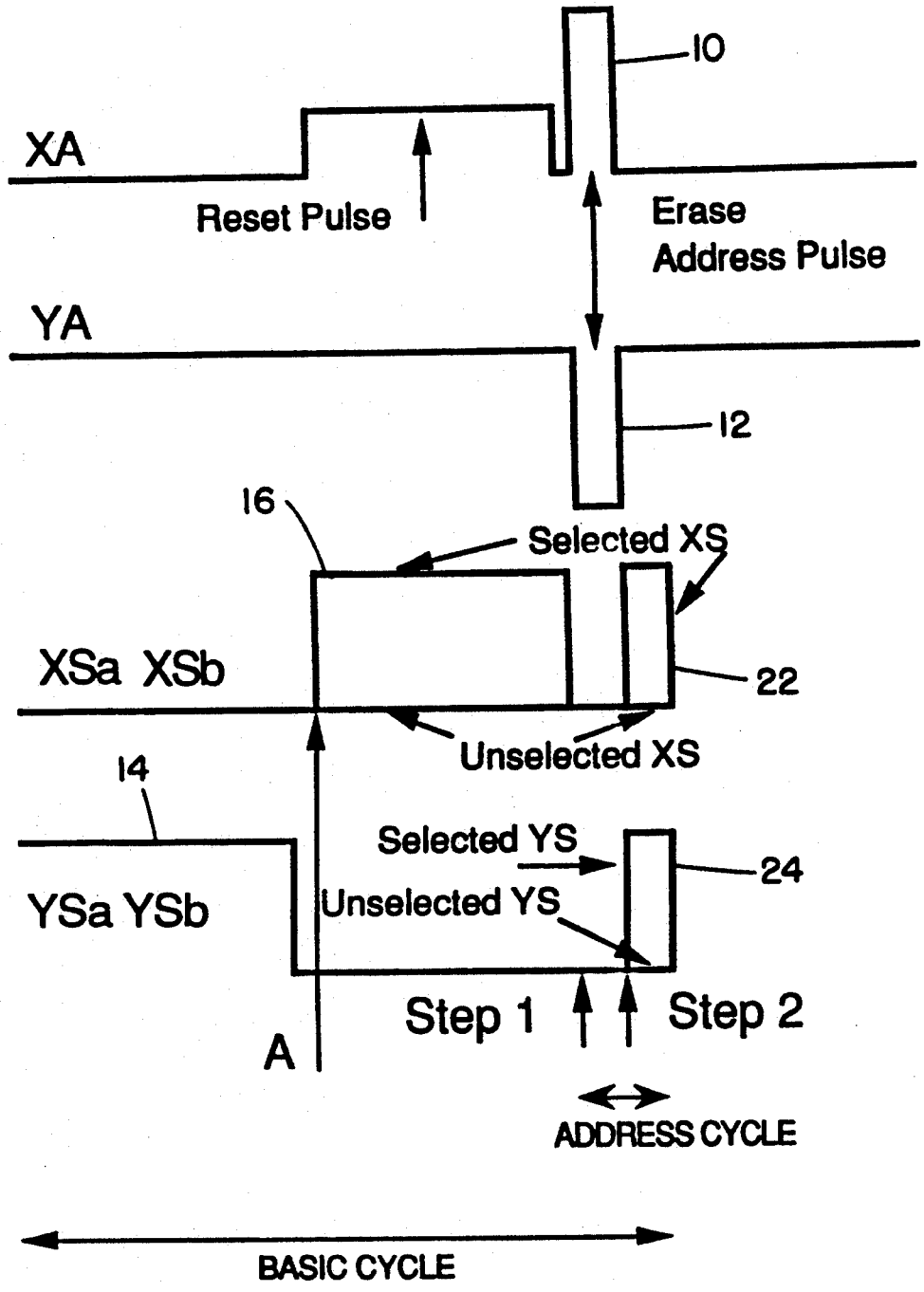
FIG. 8 is a waveform diagram showing a set of waveforms which prevents the errant erasure shown in FIG. 7*b*.

FIG. 8 illustrates the potentials supplied to the X dimension address line XA; to Y dimension address line YA; and to sustain pair lines XSa, XSb, YSa, and YSb. Those waveforms illustrate a basic cycle which accomplishes the selective erase portion of pixel addressing in the panel. That erase cycle comprises two segments, i.e., Step 1 wherein a cell group is addressed and a coupling cell therein is caused to accumulate wall charges, and Step 2 wherein the wall charges within the coupling cell are caused to migrate into a selected pixel cell to cause erasure thereof.

The selective erase commences with the application of erase address pulses 10 and 12 to the XA and YA lines respectively, to enable the addressing of an address cell in a selected cell group. Just prior to the application of pulses 10 and 12, a special sustain cycle occurs where a sustain pulse 14 is applied to the YSa and YSb sustain lines and is followed by a sustain pulse 16 applied to only one of the X dimension sustain lines. The non-pulsed X sustain line is the one that intersects the unselected pixel during the upcoming selective erase cycle. In other words, if the P1 pixel cell is to be erased, then no sustain pulse will be applied to the X dimension sustain line which intersects the P2 pixel cell.

Figure 9A:
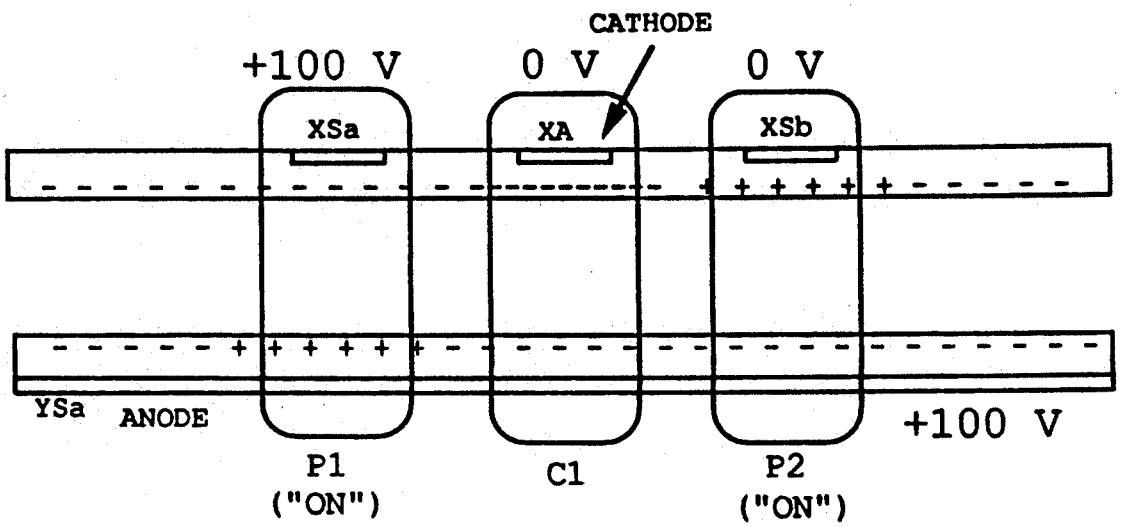
FIGS. 9*a* and 9*b* illustrate the application of the waveforms of FIG. 8 to an addressed cell group.

This can be visualized by viewing FIG. 9*a*. From the charge states on coupling cell C1, it can be seen that it is prepared to be discharged during the up-coming application of a sustain pulse to the YSa electrode.

Since pixel cell P1 is to be erased, the sustain pulse 16 (e.g., 100 volts) is applied to the XSa sustain line. That pulse causes pixel cell P1 to discharge and to reverse its wall charge state to that shown in FIG. 9*a*. On the other hand, since pixel P2 is not selected for erasure, no sustain pulse is applied to the XSb sustain line at time A, and the wall charge state in P2 remains unchanged (as shown). Thus, the polarity of wall charges in the P2 pixel cell are exactly opposite those in the P1 pixel cell after time A. This is the condition which exists at the termination of sustain pulse 16 in FIG. 8.

The subsequent application of address pulses 10 and 12 causes wall charges to be deposited in coupling cell C1, (FIG. 9*a*), thereby preparing the cell group for the Step 2 erase. That erase is accomplished by selectively applying a sustain pulse to the X and Y sustain lines which intersect the pixel to be erased. In this case, 100 volt pulses are applied to the XSa and YSa sustain lines. The sustain pulse on the YSa line causes coupling cell C1 to discharge. The electrons created by the C1 discharge migrate into pixel cell P1 and negate the positive wall charge state therein, thereby erasing the pixel. However, due to the fact that pixel cell P2 has an opposite polarity wall charge state to the sustain pulse on the YSa electrode, no discharge occurs therein.

Figure 1:
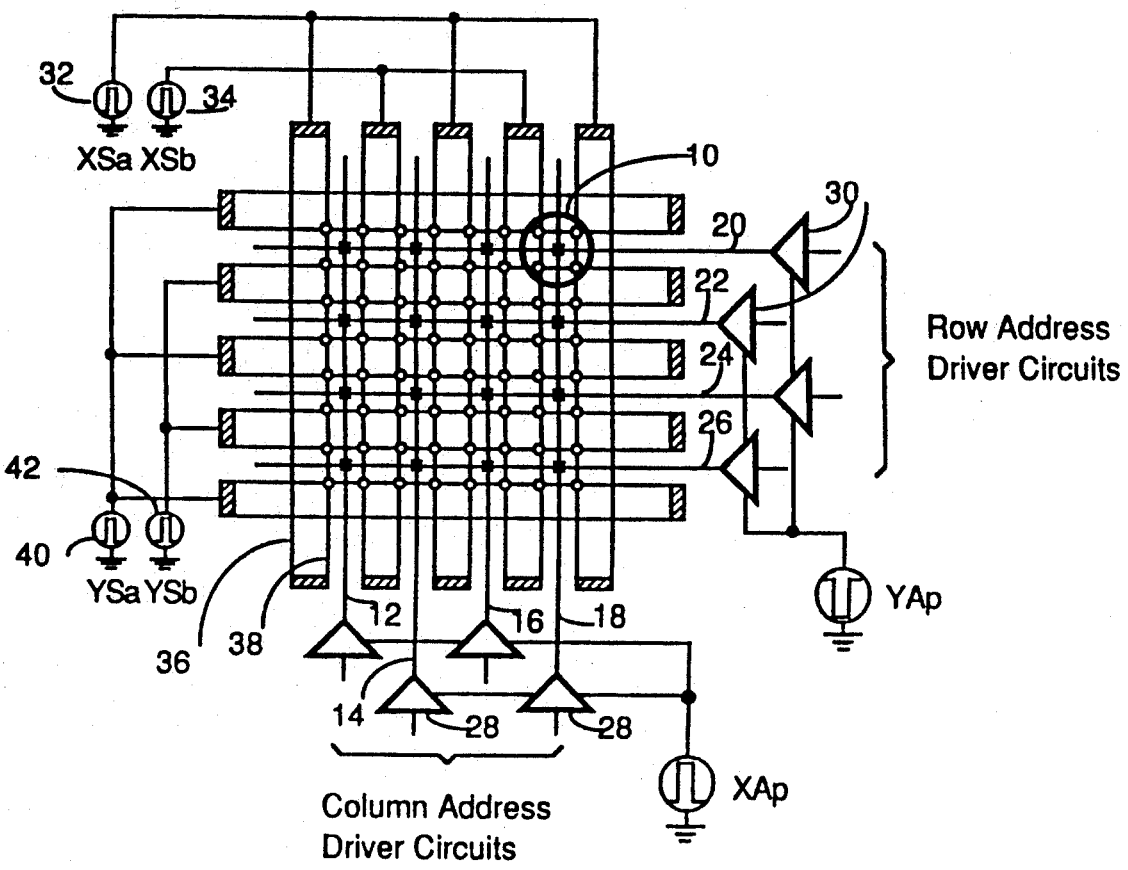
FIG. 1 is an exemplary circuit diagram of a prior art ISA AC plasma panel.
Figure 2:
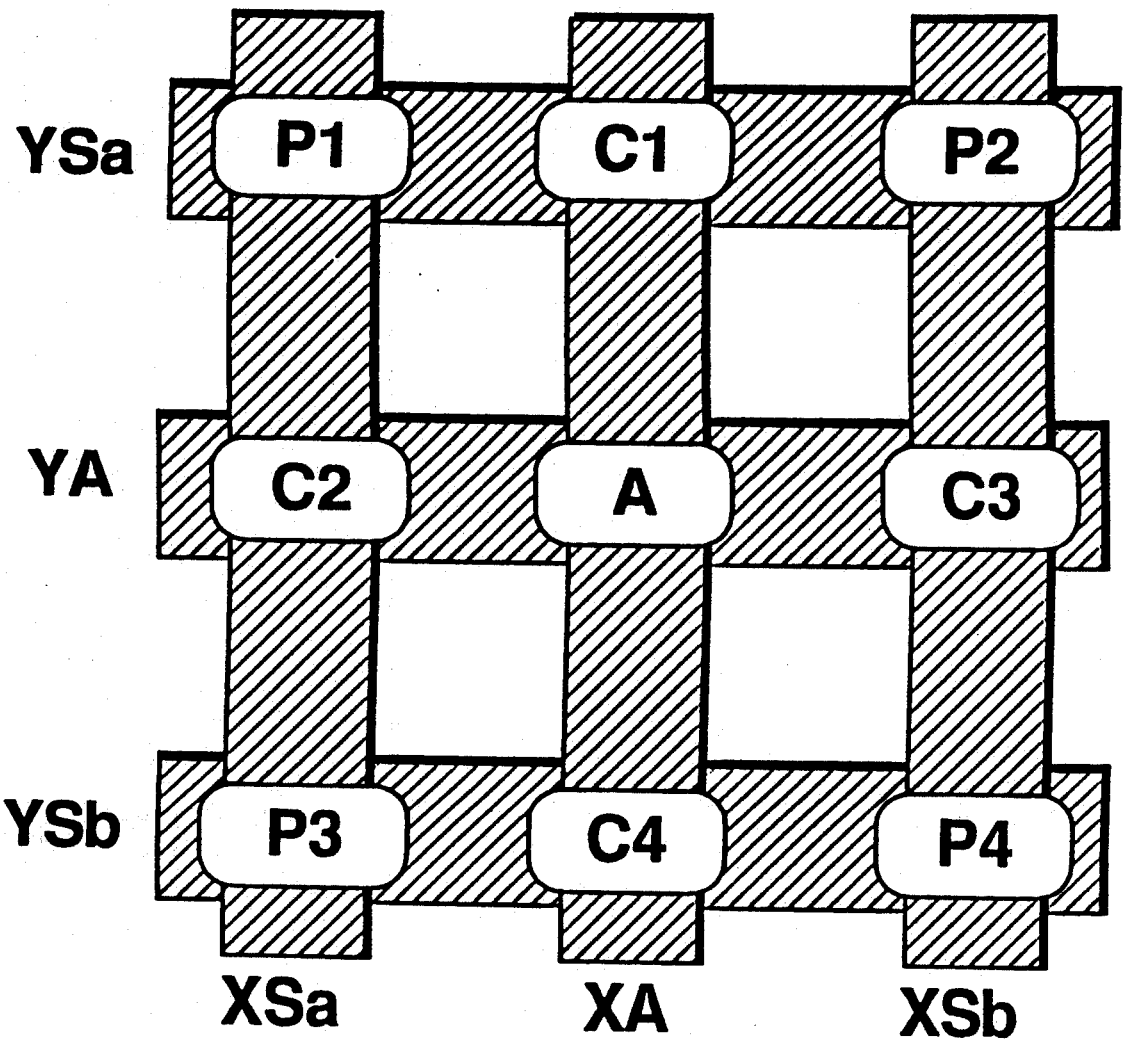
FIG. 2 is an expanded view of a cell group from FIG. 1.
Figure 3:
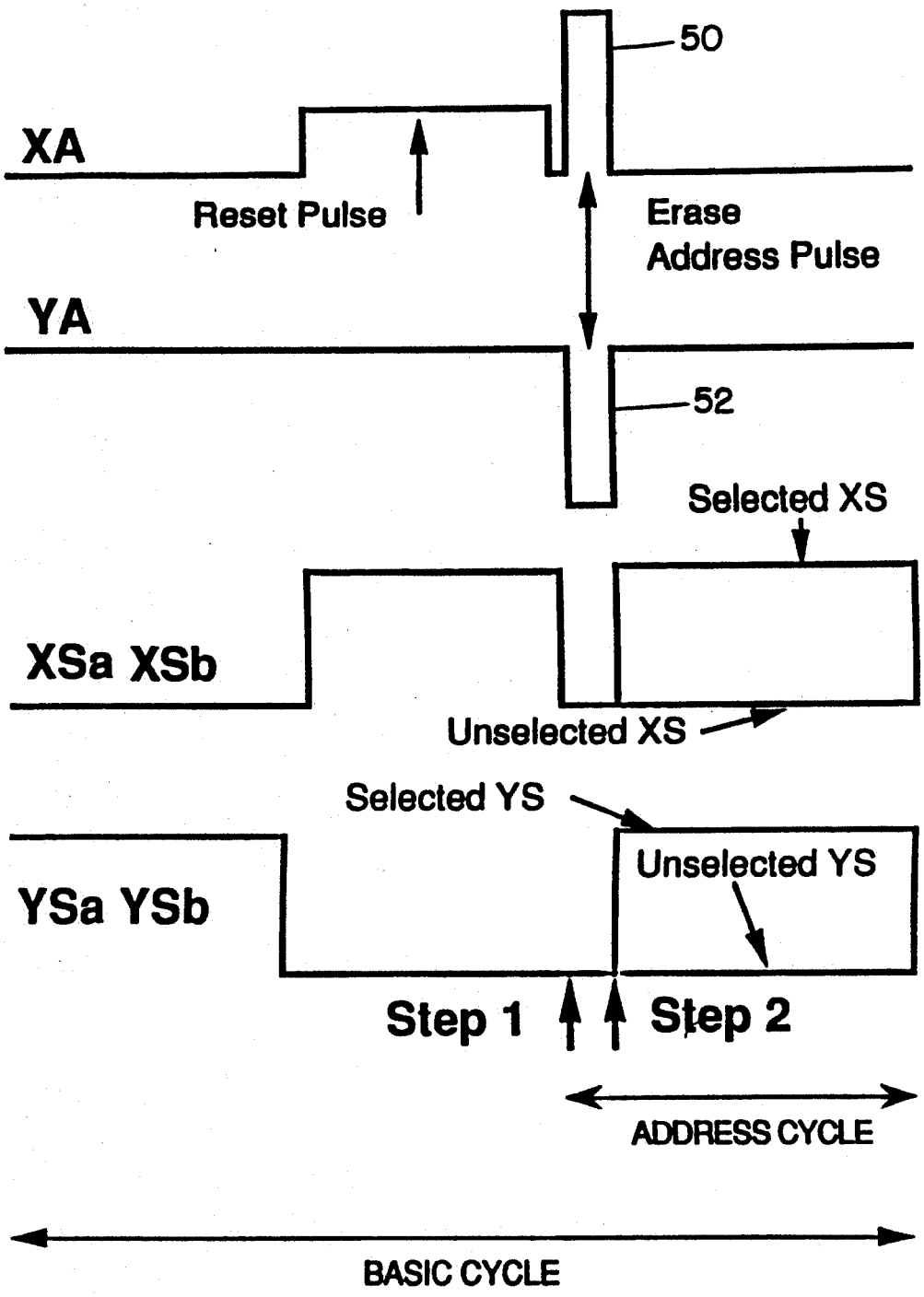
FIG. 3 shows a set of waveforms used to erase selected pixels in the AC plasma panel of FIG. 1.
Figure 4:
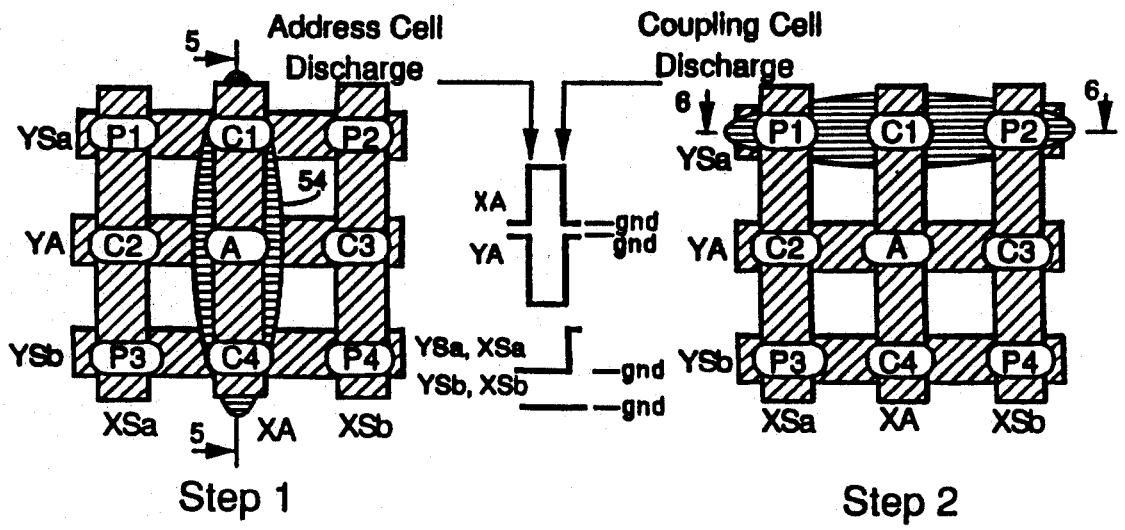
FIG. 4 illustrates the plasma spreading effects which occur during Step 1 and Step 2 of a selective erase cycle.
Figure 5:
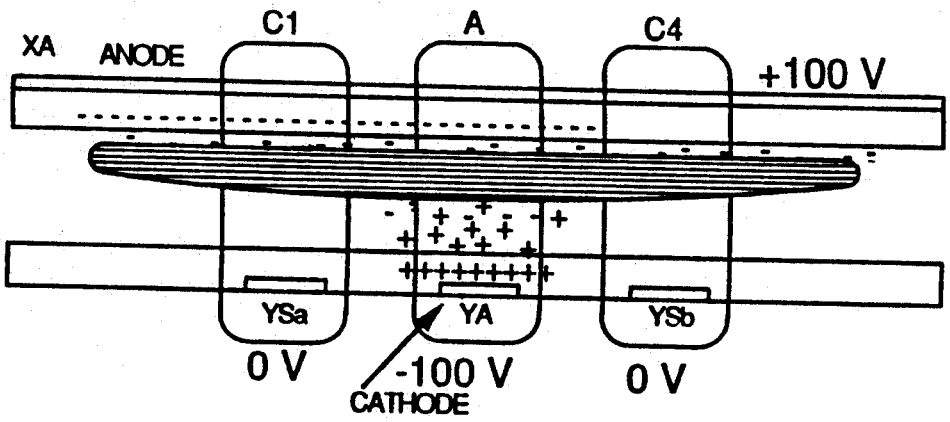
FIG. 5 is a section taken along line 5—5 in FIG. 4 (Step 1).
Figure 6A:
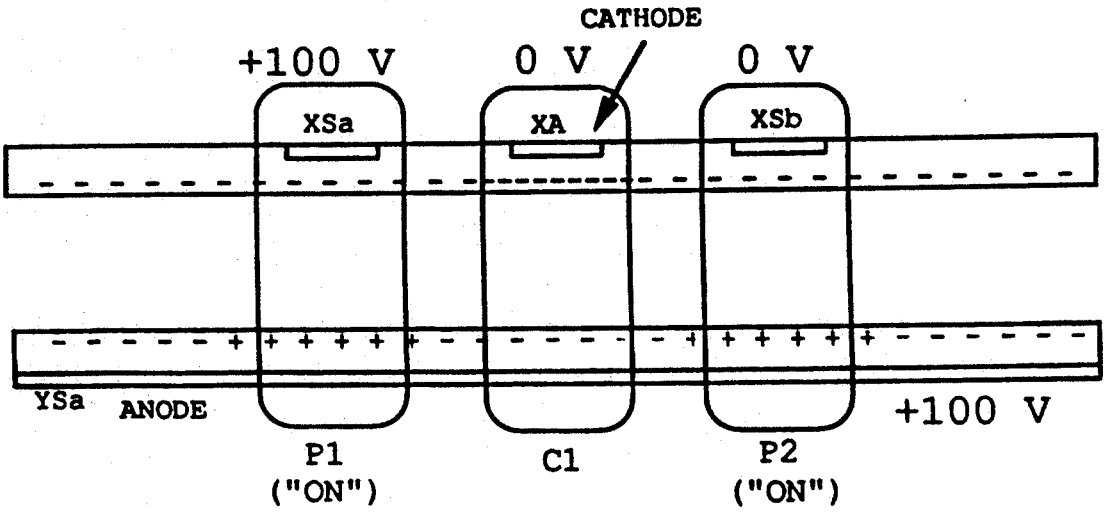
FIGS. 6*a* and 6*b* are sections taken along line 6—6 in FIG. 4 (Step 2), showing the operation of a Step 2 discharge to erase a P1 pixel cell while a P2 pixel cell is in the "ON" state.
Figure 6B:
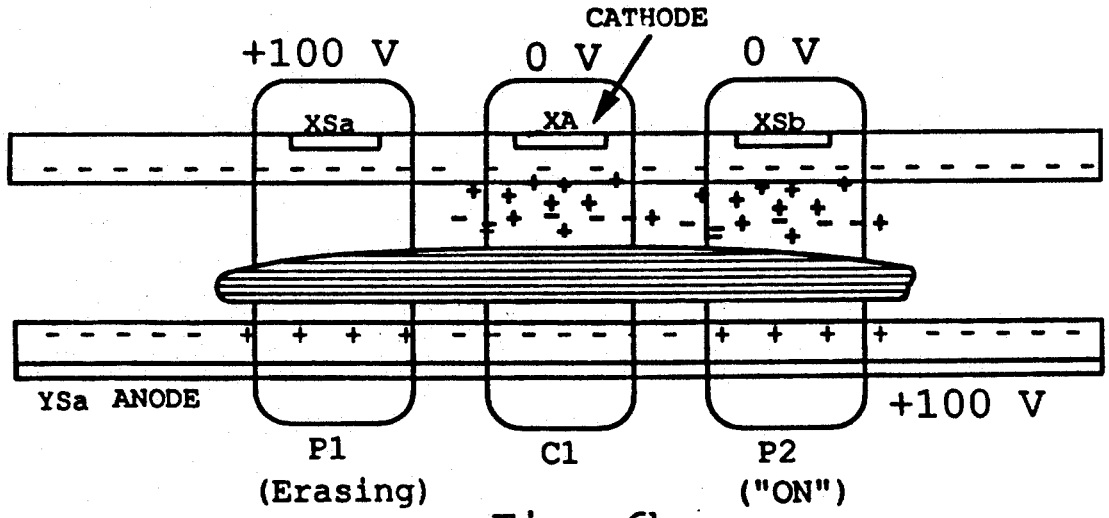
Figure 6C:
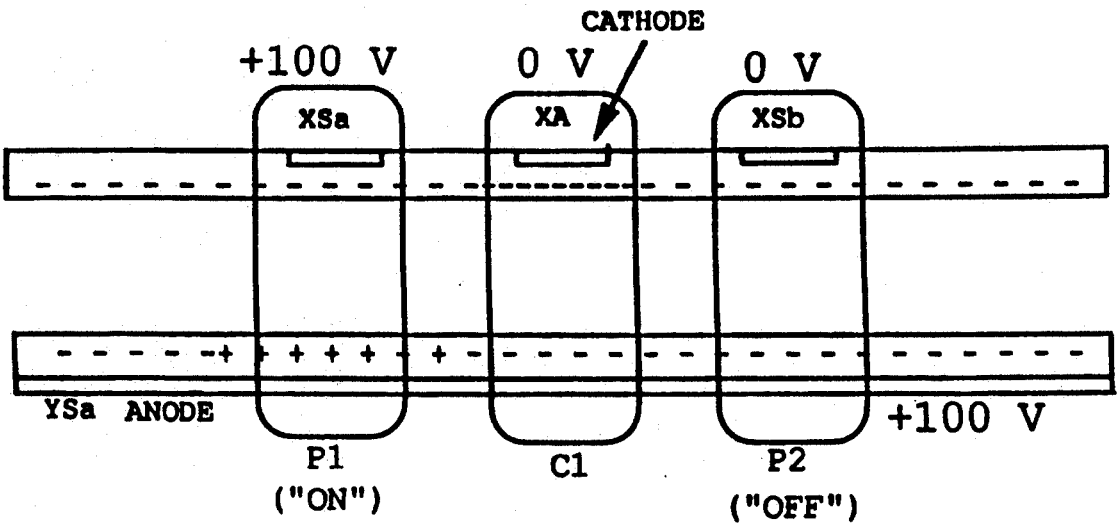
FIGS. 6*c* and 6*d* are sections taken along line 6—6 in FIG. 4 (Step 2), showing the operation of a Step 2 discharge to erase a P1 pixel cell while a P2 pixel cell is in the "off" state.
Figure 6D:
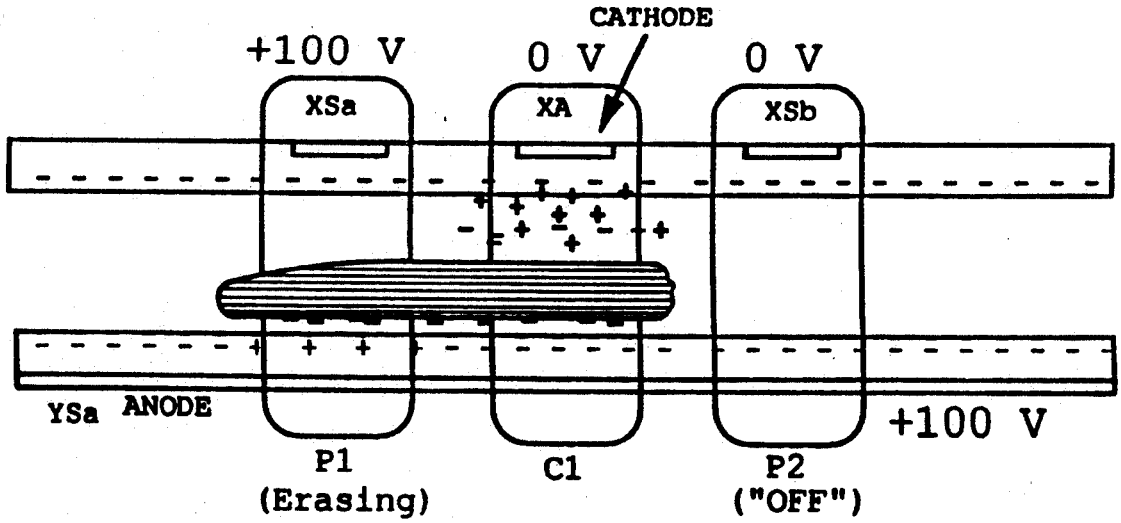
Figure 7A:
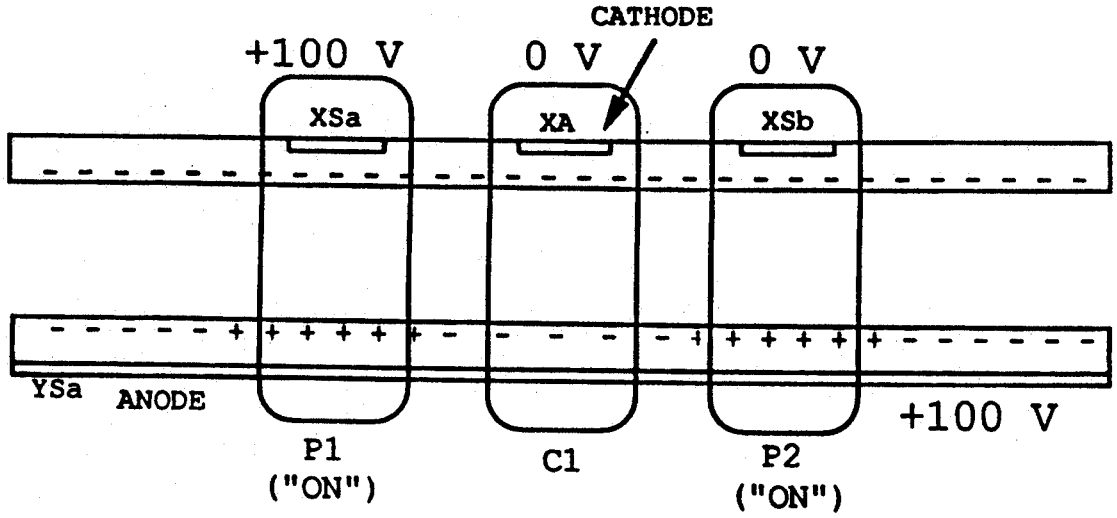
FIGS. 7*a* and 7*b* are sections taken along the YSa sustain line in a non-addressed cell group, showing an errant erasure of pixel cell P1 which results from the discharge of pixel cell P2.
Figure 7B:
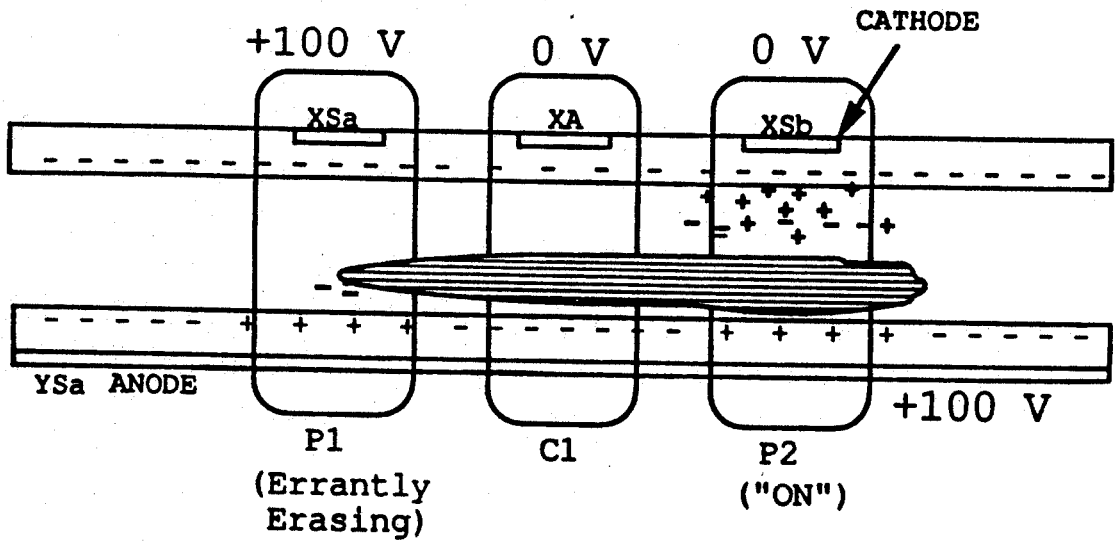
Figure 9B:
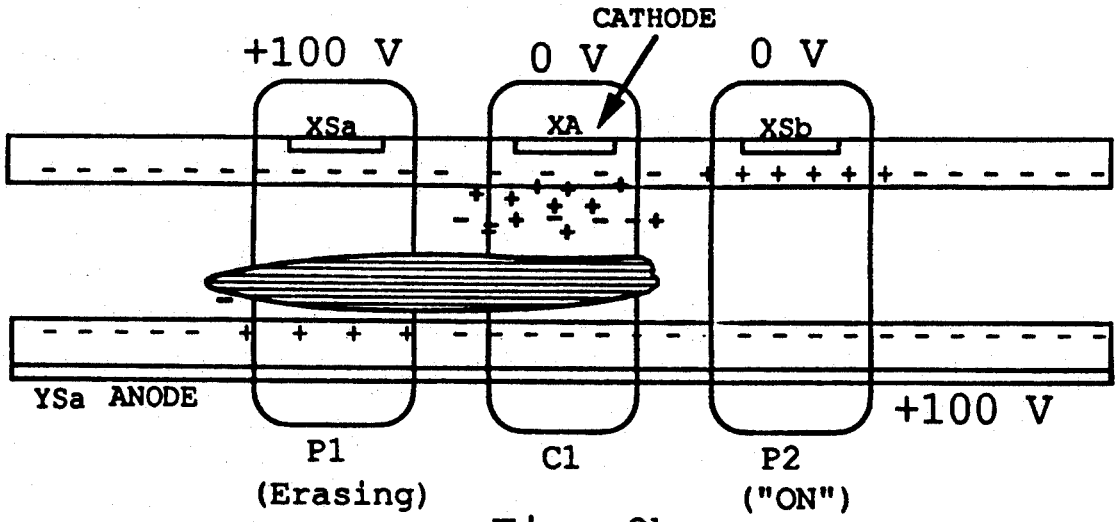
Figure 10:
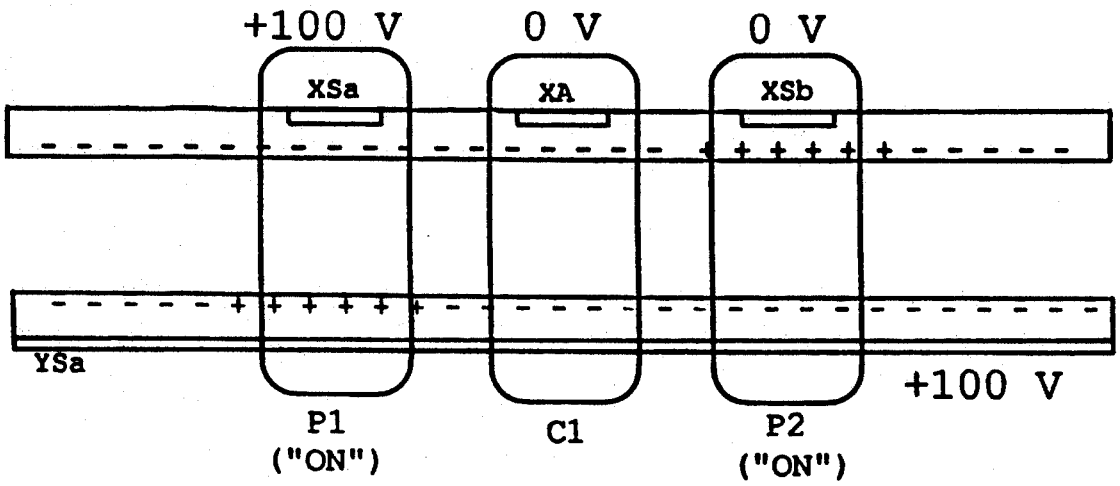
FIG. 10 illustrates the effect of the waveforms of FIG. 8 upon a non-addressed cell group during the Step 2 erase procedure.

It is to be remembered that the application of the above-described potentials on the XSa and YSa electrodes are also applied to all other cell groups (this can be seen from an examination of FIG. 1). In FIG. 10, cells (corresponding to those shown in FIGS. 9*a* and 9*b*) are illustrated for a non-addressed cell group. Coupling cell C1 has approximately equal charge states on both of its electrodes because no charge migration from an address cell has occurred. Furthermore, due to the application of the sustain pulse to only the XSa lines at time A (it being remembered that the XSb sustain line was not pulsed during the special sustain cycle), the wall charge states in pixel cells P1 and P2 exhibit opposite polarities. Since the wall charge polarity of P2 opposes the subsequently to-be-applied sustain pulse during Step 2, on YSa, a discharge is prevented within pixel cell P2 and no transfer of charge therefrom into P1 is possible.

In summary, (see FIG. 8) at time A, the XS sustain line that intersects the unselected pixel is not pulsed immediately preceding the selective erase cycle. That assures that the unselected pixel (and all identical type pixel cells elsewhere in the panel) will not discharge at Step 2 of the selective erase and cause errant erasures of unselected pixels of the same type as the pixel being erased in the addressed cell group.

Figure 11:
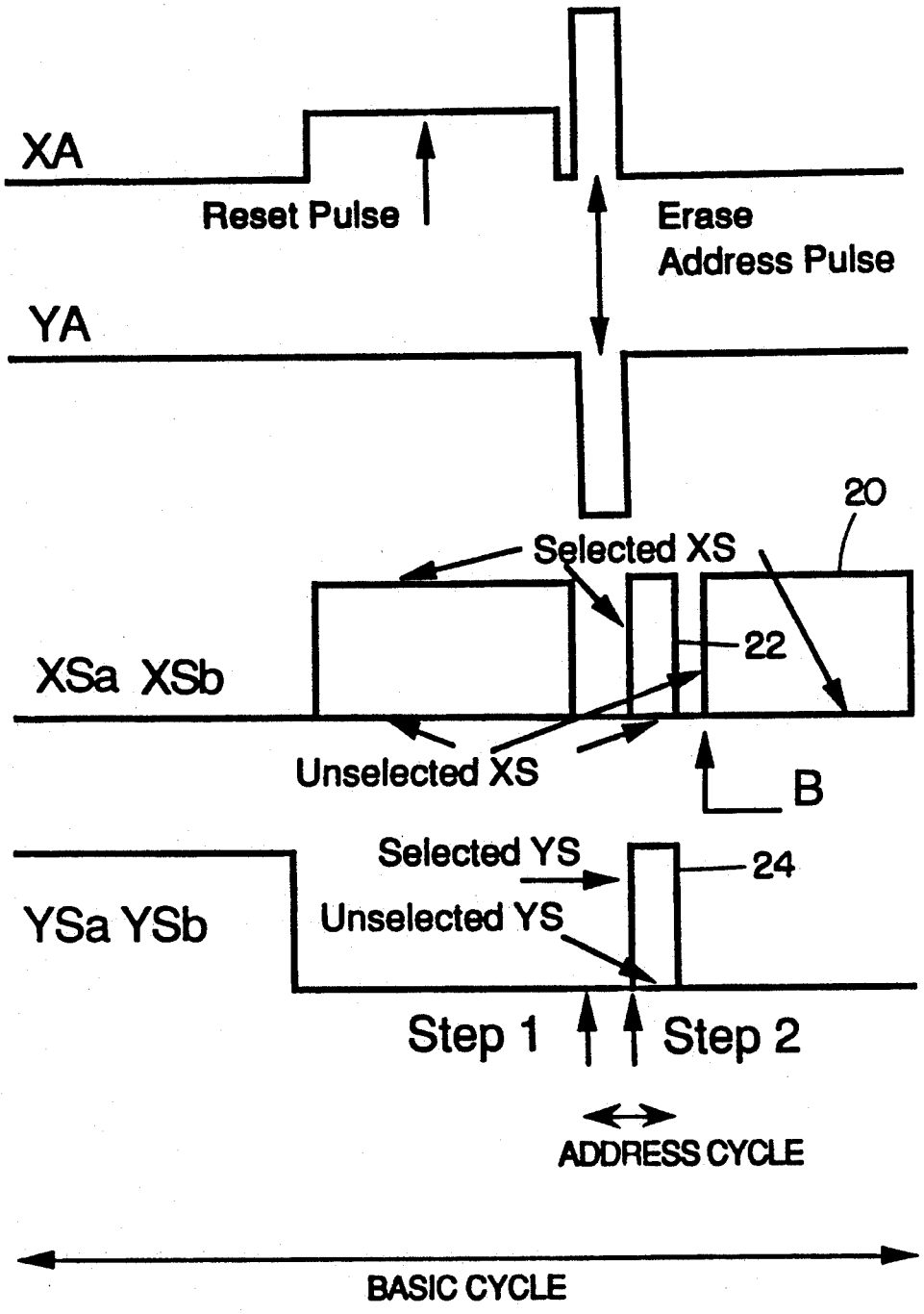
FIG. 11 is a set of waveforms illustrating the waveforms required to restore a panel's brightness after a Step 2 erase cycle.

Those skilled in the art will appreciate that the elimination of a sustain pulse during the special sustain cycle results in a decrease of the panel's brightness. A first preferred method for restoring the brightness is shown in FIG. 11 which, is in most respects identical to the waveform diagram of FIG. 8. At time B, an additional sustain pulse 20 is applied to the XS sustain line that intersects the unselected pixel. Assuming pixel cell P1 (FIG. 10) was erased, pulse 20 is applied to the XSb sustain line to discharge pixel cell P2 and cause its wall charge polarity to revert to that of pixel cell P1. (Note, Pixel cell P4 discharge at this time also.)

It is to be noted from the waveforms of FIG. 11, that during the selective erase cycle; and for awhile thereafter, the potential on the sustain lines that intersect the selected pixel cell invariably transition together. This assures that the net applied potential across the selected pixel cell being erased is continuously zero. Thus, charges in the ionized gas are able to migrate, free from affects of induced voltages, into the selected pixel cell to accomplish the erasure.

Figure 12:
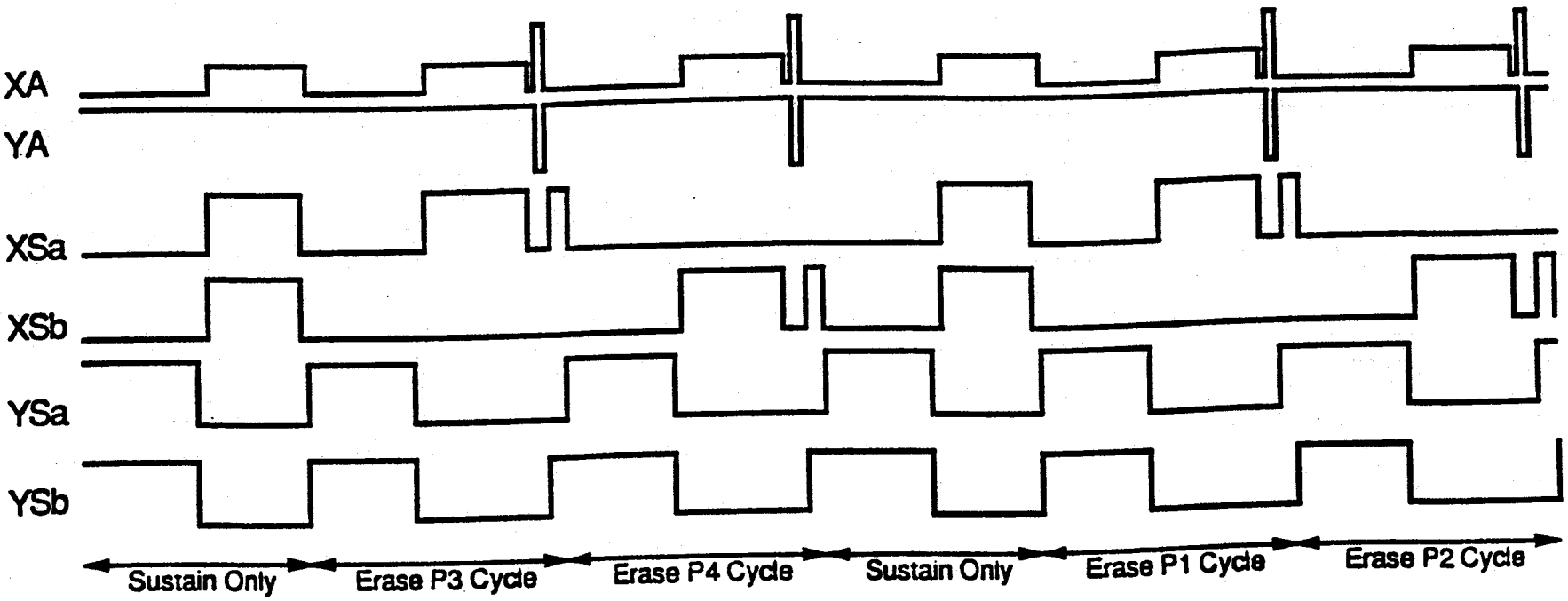
FIG. 12 is a waveform diagram illustrating an alternative technique for restoring brightness to a panel after a Step 2 erase cycle.

Another preferred method for restoring the brightness of the panel is shown in FIG. 12. In this case, there are four erasure cycles, one for each pixel cell type. Each erasure cycle is identical to that shown in FIG. 8. However, for each four erasure cycles, there needs to be two "sustain only" cycles, each of which includes a pair of sustain pulses to cause the ON pixel cells in the panel to discharge, thereby restoring its brightness. It is to be noted that this operation causes the reorientation of the wall charge polarity states in the unselected pixels automatically and without requiring any special extra pulse. As aforestated, when a pixel cell P1 is to be erased, a sustain pulse is not applied to pixel cells P2 during the P1 erase cycle. However, when a pixel cell P2 is to be subsequently erased, the special sustain cycle eliminates a sustain pulse from being applied to the P1 pixel cells. As a result, ON pixel cells P2 are caused to discharge and thus "catch up" with previously discharged ON P1 pixel cells, so that their wall charge polarities now match.

It is parenthetically to be noted that the above described procedure also affects the states of pixel cells P3 and P4, as pixel cells P1 and P2 are being operated. However, due to the construction of the panel, pixel cells P3 and P4 are automatically corrected and controlled by the same waveforms which correct and control the wall charge states of the P1 and P2 pixel cells.

A significant operational benefit accrues from the elimination of the unselected pixel cell's sustain discharge during the special sustain cycle. It is known to those skilled in the art that to sustain a pixel cell discharge, a sustain pulse of substantial duration must be applied across the pixel cell (e.g. on the order of five or more microseconds). It is also known that the discharge of a coupling cell can be accomplished with a much shorter duration pulse than that which causes a sustain discharge of a pixel cell. Thus, by avoiding discharge of an unselected pixel during erase, a much shorter pulse can then be used to discharge the coupling cell and erase the selected pixel cell. This can be seen by examining the duration of sustain pulse 16 in FIG. 8 and comparing its duration to the duration of pulses 22 and 24 (which cause the erasure of the selected pixel cell). Pulses 22 and 24 can be approximately one microsecond in length during Step 2 of the selective erase procedure. This reduction in time required to update the state of a pixel is of significant value and enables high image update requirements to be met. Thus, not only does this improve the driving method to remove a failure mode from the operation of an ISA plasma display panel, but it also provides the panel with an ability to perform faster image update procedures (useful when presenting grey scales and for panels with large numbers of pixels).

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

We claim:

1. A method for erasing pixel cells in an ISA AC plasma display panel, wherein said panel comprises a plurality of cell groups aligned along first and second orthogonal dimensions, each said cell group including an address cell, two first dimension coupling cells, two second dimension coupling cells and four pixel cells, first dimension and second dimension address lines intersecting each said address cell, and sustain lines positioned on either side of each said address line and intersecting adjacent series of pixel cells and coupling cells in each cell group, intersections between sustain lines defining said pixel cells by type, each cell group having identical first through fourth types at corresponding sustain line intersections, said method comprising:

a. energizing said address and sustain lines to turn ON at least a selected first type pixel cell in an addressed cell group, said first type pixel cell and a second type pixel cell respectively resident at intersections between a first dimension sustain line and first and second, second dimension sustain lines;

b. applying sustain pulses to said sustain lines, with at least one less sustain pulse being applied to second dimension sustain lines which intersect said second type pixel cells in all cell groups;

c. applying erase address potentials to selected first and second dimension address lines to induce wall charges in second dimension coupling cells associated with an address cell in an addressed cell group; and d. applying to said sustain lines a potential to cause discharge of a second dimension coupling cell and a resulting migration of charge into an ON first type pixel cell, whereby erasure of said selected first type pixel cell in said addressed cell group is achieved.

2. The method as defined in claim 1, further comprising the step of:

e. controlling said signal pulses and potentials applied during step (d) to aid first type pixel cell to be erased, to assure the net applied potential thereacross remains zero.

3. The method as defined in claim 1 wherein step (b) results in all second type pixel cells which are ON to exhibit an opposite polarity wall charge state to a wall charge state in said first type pixel cell turned ON in step (a).

4. The method as defined in claim 3 wherein said wall charge state polarities in said ON second type pixel cells are in opposition to said potential applied in step (d).

5. The method as defined in claim 4 wherein step (d) applies said potential between said fit dimension sustain line and said first, second dimension sustain line.

6. The method as defined in claim 5 wherein said potential is pulsate and exhibits a substantially lesser duration than a duration of a said sustain signal pulse.

7. The method as defined in claim 6 further comprising the additional step of:

e. applying a sustain pulse to said second, second dimension sustain lines to thereby cause second type pixel cells which are ON, to exhibit a wall charge polarity state identical to all first and third pixel cell types which are ON.

8. The method as defined in claim 6 wherein step (a) causes the turn ON of both said selected fist type pixel cell and a second type pixel cell in said addressed cell group, said method including the further steps of:

e. applying sustain pulses to said sustain lines, with at least one less sustain pulse being applied to second dimension sustain liens which intersect said first type pixel cells in all cell groups; and f. applying to said sustain lines a potential to cause erasure of a selected second type pixel in an addressed cell group.

9. The method as defined in claim 8 further comprising the step of:

g. applying sustain pulses to aid first and second dimension sustain lines to increase the brightness of said display panel.

10. A method for erasing pixel cells in an ISA AC plasma display panel, wherein said panel comprises a plurality of cell groups aligned along horizontal and vertical dimensions, each said cell group including an address cell, two vertical coupling cells, two horizontal coupling cells and four pixel cells, horizontal and vertical address lines intersecting each said address cell, and sustain liens positioned on either side of each said address line and intersecting adjacent series of pixel cells and coupling cells in each cell group, intersections between said sustain liens defining said pixel cells by type, each cell group having identical first through fourth types at corresponding sustain line intersections, said method comprising:

a. energizing said address and sustain lines to turn ON at least a selected first type pixel cell in an addressed cell group, said first type pixel cell and a second type pixel cell respectively resident at intersections between a horizontal sustain line and first and second vertical sustain lines;

b. applyign sustain pulses to said sustain lines, with at least one less sustain pulse being applied to vertical sustain liens which intersect said second type pixel cells in all cell groups; and c. applying erase address potentials to selected horizontal and vertical address liens to discharge an address cell in an addressed cell group at an intersection of said address liens and create wall charges in vertical coupling cells in said addressed cell group; and d. applying to said sustain liens a potential to cause discharge of a vertical coupling cell having wall charges created in step(c) and a resulting migration of charge into an ON first type pixel cell, whereby erasure of said selected first type pixel in said addressed cell group is caused.

11. The method as defined in claim 10, further comprising the step of:

e. controlling said applied sustain pulses and potentials applied during step (d) to a cell type to be erased to assure that the net applied potential thereacross remains zero.

12. The method as defined in claim 10 wherein step (a) results in all said first through fourth type pixel cells in said addressed cell group being turned ON.

13. The method as defined in claim 12 wherein step (d) applies said potential between said horizontal sustain line and said first vertical sustain line.

14. The method as defined in claim 13 wherein said potential is pulsate and exhibits a substantially lesser duration than said sustain signal pulse.

15. The method as defined in claim 14 wherein step (a) turns ON all four pixel types in said address cell group, said method comprising the further steps of:

e. subsequently applying sustain pulses to said sustain liens, with at least one less sustain signal pulse being applied to said first vertical sustain lines; and f. applying between said horizontal sustain line and said second vertical sustain lines a sustain pulse to cause erasure of said second type pixel cell in said addressed cell group.

16. The method as defined in claim 15 further comprising the step of:

g. applying sustain pulses subsequent to step (f) to enhance the brightness of said panel.

17. The method as defined in claim 14 further comprising the step of:

e. applying a sustain pulse to said second vertical sustain lines to discharge second and fourth type pixel cells which are in the ON state, and cause their wall charge polarities to match those of first and third pixel cell types which are ON.

* * * * *

UNITED STATES PATENT AND TRADEMARK OFFICE

CERTIFICATE OF CORRECTION

PATENT NO. : 5,250,936

DATED : 10/5/93

INVENTOR(S) : Warren et al

It is certified that error appears in the above-indentified patent and that said Letters Patent is hereby corrected as shown below:

In col. 9, line 19, replace the word "aid" with --said--.

In col. 9, line 31, replace the word "fit" with --first--.

In col. 9, line 34, replace the word "pulsate" with --pulsatile--.

In col. 9, line 44, replace the word "fist" with --first--.

In col. 9, line 49, replace the word "liens" with --lines--.

In col. 9, line 56, replace the word "aid" with --said--.

In col. 9, line 66, replace the word "liens" with --lines--.

In col. 10, line 3, replace the word "liens" with --lines--.

In col. 10, line 13, replace the word "applyign" with --applying--.

In col. 10, line 15, replace the word "liens" with --lines--.

In col. 10, line 18, replace the word "liens" with --lines--.

In col. 10, line 20, replace the word "liens" with --lines--.

UNITED STATES PATENT AND TRADEMARK OFFICE

CERTIFICATE OF CORRECTION

PATENT NO. : 5,250,936

DATED : 10/5/93

INVENTOR(S) : Warren et al

It is certified that error appears in the above-indentified patent and that said Letters Patent is hereby corrected as shown below:

Column 10, line 23, replace the word "liens" with --lines--.

Column 10, line 43, replace the word "pulsate" with --pulsatile --.

Column 10, line 49, replace the word "liens" with --lines--.

Signed and Sealed this

Third Day of May, 1994

Bruce Lehman

*Attest:*

BRUCE LEHMAN

*Attesting Officer*

*Commissioner of Patents and Trademarks*